US008384293B2

(12) United States Patent
Liao

(10) Patent No.: US 8,384,293 B2
(45) Date of Patent: Feb. 26, 2013

(54) LAMP BRIGHTNESS REMOTE CONTROLLING DEVICE

(75) Inventor: Ming-Hong Liao, Taipei Hsien (TW)

(73) Assignee: Eiko (Pacific) Ltd., Port Louis (MU)

( * ) Notice: Subject to any disclaimer, the term of this patent is extended or adjusted under 35 U.S.C. 154(b) by 376 days.

(21) Appl. No.: 12/830,346

(22) Filed: Jul. 4, 2010

(65) Prior Publication Data

US 2011/0248636 A1 Oct. 13, 2011

(30) Foreign Application Priority Data

Apr. 8, 2010 (TW) ..... 99206203 U

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |
| ***H05B 41/00*** | (2006.01) |

(52) U.S. Cl. ..... 315/149; 315/312; 315/294

(58) Field of Classification Search ..... 315/149, 315/294, 291, 312, 307

See application file for complete search history.

(56) References Cited

U.S. PATENT DOCUMENTS

| | | | | |
|---|---|---|---|---|
| 6,771,182 | B1 * | 8/2004 | Loh et al. | 340/12.28 |
| 7,498,952 | B2 * | 3/2009 | Newman, Jr. | 340/815.45 |
| 7,902,759 | B2 * | 3/2011 | Newman, Jr. | 315/149 |
| 8,009,042 | B2 * | 8/2011 | Steiner et al. | 340/541 |
| 2008/0218099 | A1 * | 9/2008 | Newman | 315/268 |
| 2008/0265799 | A1 * | 10/2008 | Sibert | 315/292 |
| 2010/0327766 | A1 * | 12/2010 | Recker et al. | 315/291 |
| 2012/0013257 | A1 * | 1/2012 | Sibert | 315/152 |

* cited by examiner

*Primary Examiner* — Shawki Ismail
*Assistant Examiner* — Dylan White
(74) *Attorney, Agent, or Firm* — CKC & Partners Co., Ltd.

(57) ABSTRACT

A lamp brightness remote controlling device is provided for regulating a brightness level of a lamp correspondingly provided with a wireless receiver unit, and includes a first central processor, to which an ambient brightness detector, a setting key, and a wireless transmitter module are electrically connected. The first central processor compares a user-set brightness level set by a user via the setting key with an ambient brightness detected by the ambient brightness detector, computes, and then outputs a comparison signal to the wireless transmitter module for transmitting to the wireless receiver unit on the lamp, so that a luminance of the lamp is automatically regulated to always keep a working environment at the user-set brightness level.

7 Claims, 3 Drawing Sheets

LAMP BRIGHTNESS REMOTE CONTROLLING DEVICE

RELATED APPLICATIONS

This application claims priority to Taiwan Application Serial Number 99206203, filed Apr. 8, 2010, which is herein incorporated by reference.

FIELD OF THE INVENTION

The present invention relates to a remote controlling device, and more particularly to a lamp brightness remote controlling device.

BACKGROUND OF THE INVENTION

Generally, a lamp can be controlled to different brightness levels by operating an adjustment knob to adjust a resistance value of the lamp, so that the luminance of the lamp is regulated. Conventionally, the adjustment knob is arranged at a position separated from the lamp. As being restricted by the wiring thereof, the adjustment knob could not be conveniently installed for use.

To overcome the above disadvantages, a lamp with remotely controllable brightness is developed. This type of lamp is equipped with a remote controller, with which a user can wirelessly control the lamp to different brightness levels.

The conventional lamp remote controller is designed for directly controlling the luminance emitted by the lamp. Once the lamp luminance is regulated via the remote controller, it is constant and not automatically adjustable according to an ambient brightness. However, in most cases, there would be some extent of light in our living or working environment to create an ambient brightness. And, the ambient brightness varies with weather and other environment conditions. Since the luminance emitted from the lamp under control of the conventional remote controller is constant and not changeable with the ambient brightness, the lamp might be too bright or too dark to the user in the actual living or working environment. Therefore, a user still has to manually operate the remote controller now and then to regulate the lamp brightness in order to keep the living or working environment at a desired brightness level.

It is therefore necessary to develop an improved lamp brightness remote controlling device that enables a lamp to automatically regulate the luminance thereof in response to the ambient brightness.

SUMMARY OF THE INVENTION

A primary object of the present invention is to provide a lamp brightness remote controlling device to eliminate the drawbacks in the conventional lamp brightness remote controller, so that the luminance of a lamp can be controlled in response to ambient brightness in a working environment to always keep the working environment at a preset level of brightness.

To achieve the above and other objects, the lamp brightness remote controlling device according to an embodiment of the present invention can regulate a brightness level of a lamp correspondingly provided with a wireless receiver unit and includes a first central processor; an ambient brightness detector electrically connected to the first central processor; a setting key electrically connected to the first central processor; a wireless transmitter module electrically connected to the first central processor; and a first power supply electrically connected to the first central processor, the ambient brightness detector, and the wireless transmitter module. The first central processor compares a user-set brightness level set by a user via the setting key with an ambient brightness detected by the ambient brightness detector, computes, and then outputs a comparison signal to the wireless transmitter module for transmitting to the wireless receiver unit on the lamp, so that a luminance of the lamp is automatically regulated according to the comparison signal to keep a working environment at the user-set brightness level.

According to an embodiment of the present invention, the wireless receiver unit on the lamp includes a second central processor; a wireless receiver module electrically connected to the second central processor; a lamp light controller electrically connected to the second central processor and a light emitting element of the lamp; and a second power supply electrically connected to the second central processor, the wireless receiver module, and the lamp light controller. The wireless receiver module receives the comparison signal transmitted from the wireless transmitter module; the second central processor processes the received comparison signal and outputs a control signal to the lamp light controller for controlling the luminance of the light emitting element of the lamp and accordingly the brightness of the lamp.

According to an embodiment of the present invention, the lamp brightness remote controlling device further includes a timer electrically connected to the first central processor for setting time intervals at which the ambient brightness detector automatically detects ambient brightness.

According to an embodiment of the present invention, the lamp brightness remote controlling device further includes a display module electrically connected to the first central processor for showing the user-set brightness level and the detected ambient brightness.

According to an embodiment of the present invention, the lamp brightness remote controlling device further includes a backlight module electrically connected to the first central processor for providing a backlight source to the display module.

According to an embodiment of the present invention, the lamp brightness remote controlling device further includes an auto/manual module electrically connected to the first central processor for switching the remote controlling device between different operation modes.

According to an embodiment of the present invention, the wireless receiver unit further includes a memory module electrically connected to the second central processor and the second power supply for storing user-set data on the memory module.

According to an embodiment of the present invention, the wireless receiver unit further includes a self-learning switch electrically connected to the second central processor for triggering perfect coordination and match between the remote controlling device and the wireless receiver unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein FIG. 1 schematically shows the use of a lamp brightness remote controlling device according to an embodiment of the present invention to control a lamp to different levels of brightness.

DETAILED DESCRIPTION OF THE PREFERRED EMBODIMENTS

The present invention will now be described with a preferred embodiment thereof. Please refer to FIG. 1 that schematically shows the use of a lamp brightness remote controlling device 100 according to an embodiment of the present invention to control a lamp 300 to different levels of brightness, to FIG. 2 that is a configuration block diagram of the lamp brightness remote controlling device 100, and to FIG. 3 that is a configuration block diagram of a wireless receiver unit 200 provided on the lamp 300 to coordinately work with the lamp brightness remote controlling device 100.

As shown, the lamp brightness remote controlling device 100 is designed for use with a lamp 300 correspondingly provided with a wireless receiver unit 200.

Figure 1:
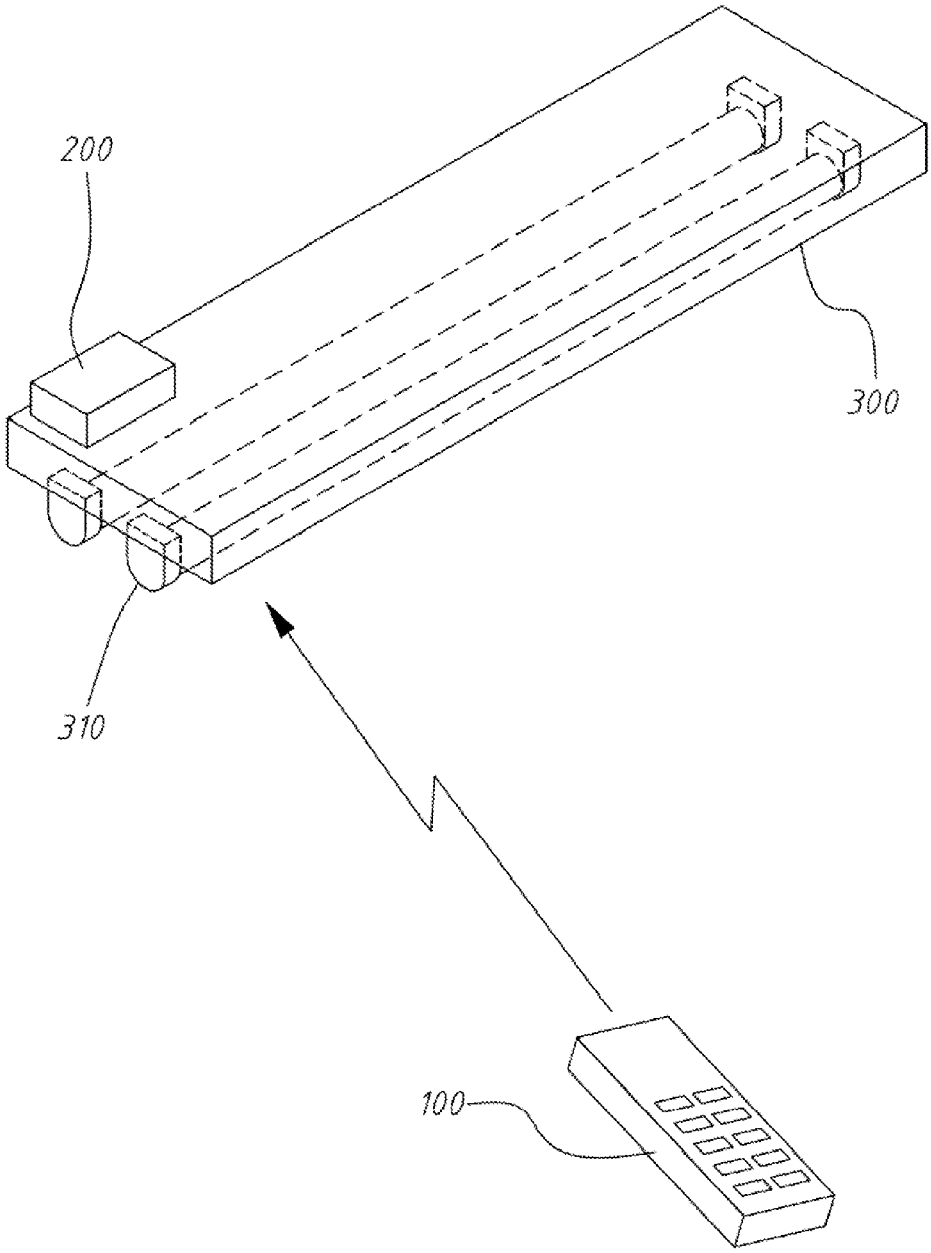
Figure 2:
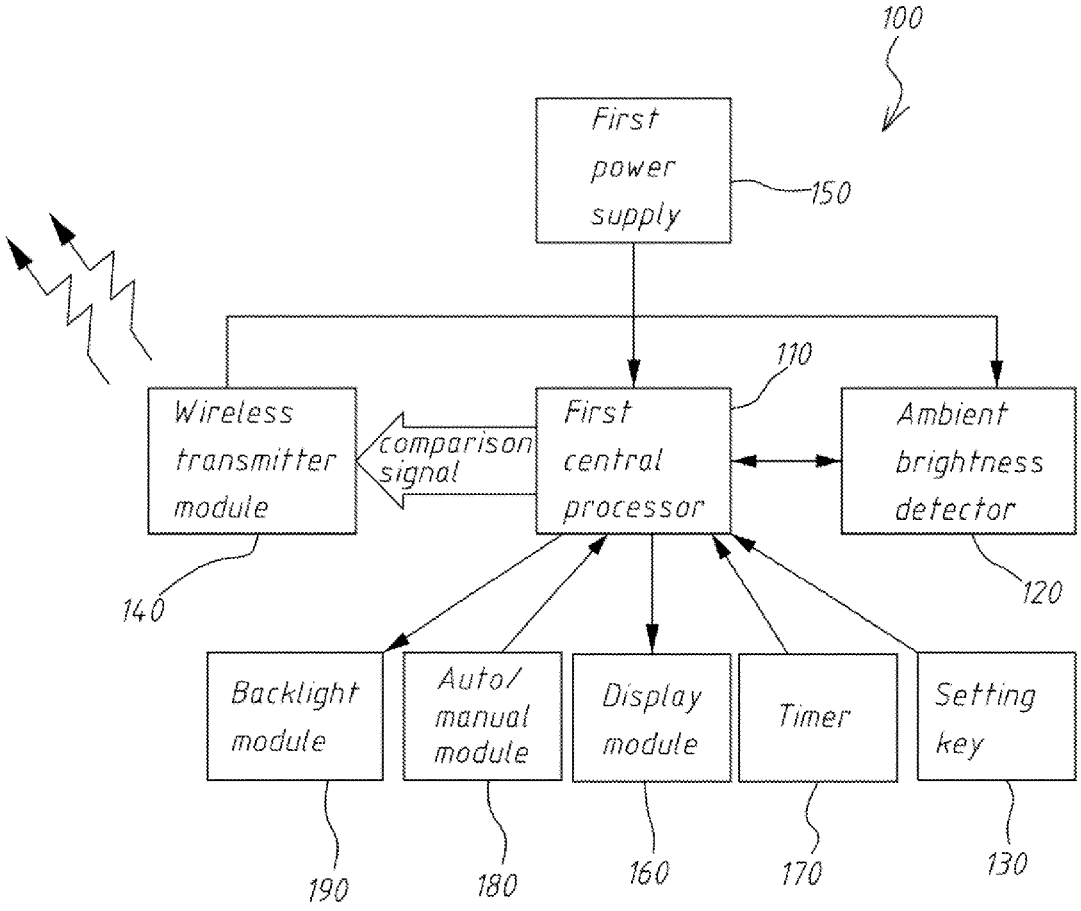
FIG. 2 is a configuration block diagram of the remote controlling device of FIG. 1.

Please refer to FIGS. 1 and 2 at the same time. The lamp brightness remote controlling device 100 includes a first central processor 110, an ambient brightness detector 120, a setting key 130, a wireless transmitter module 140, a first power supply 150, a display module 160, a timer 170, an auto/manual module 180, and a backlight module 190. The ambient brightness detector 120, the setting key 130, the wireless transmitter module 140, the display module 160, the timer 170; the auto/manual module 180, and the backlight module 190 are electrically connected to the first central processor 110. The first power supply 150 can be, for example, a battery and is electrically connected to the first central processor 110, the ambient brightness detector 120 and the wireless transmitter module 140 for supplying power needed by these components to operate.

The setting key 130 is an input interface, via which a user can set a predetermined brightness level for a working environment, such as a worktable. The ambient brightness detector 120 can detect an ambient brightness at the working environment. A signal representing the user-set brightness level and a signal representing the detected ambient brightness are input to the first central processor 110 for computing. After computing, the first central processor 110 outputs a comparison signal to the wireless transmitter module 140 for transmitting. The timer 170 can be used to set time intervals at which the ambient brightness detector 120 detects the ambient brightness. That is, via the timer 170, the ambient bright detector 120 can be set to execute the ambient brightness detection at a regular time period of 30 minutes, for example.

The display module 160 can be, for example, a liquid crystal display (LCD) screen for showing the user-set brightness level set via the setting key 130 and the ambient brightness detected by the ambient brightness detector 120. The backlight module 190 provides a backlight source to the display module 160.

The auto/manual module 180 is an operation-mode switching element. In an auto-operation mode, the lamp brightness remote controlling device 100 automatically remotely controls the brightness of the lamp 300; and in a manual-operation mode, the lamp brightness remote controlling device 100 is manually operated to remotely control the brightness of the lamp 300.

Figure 3:
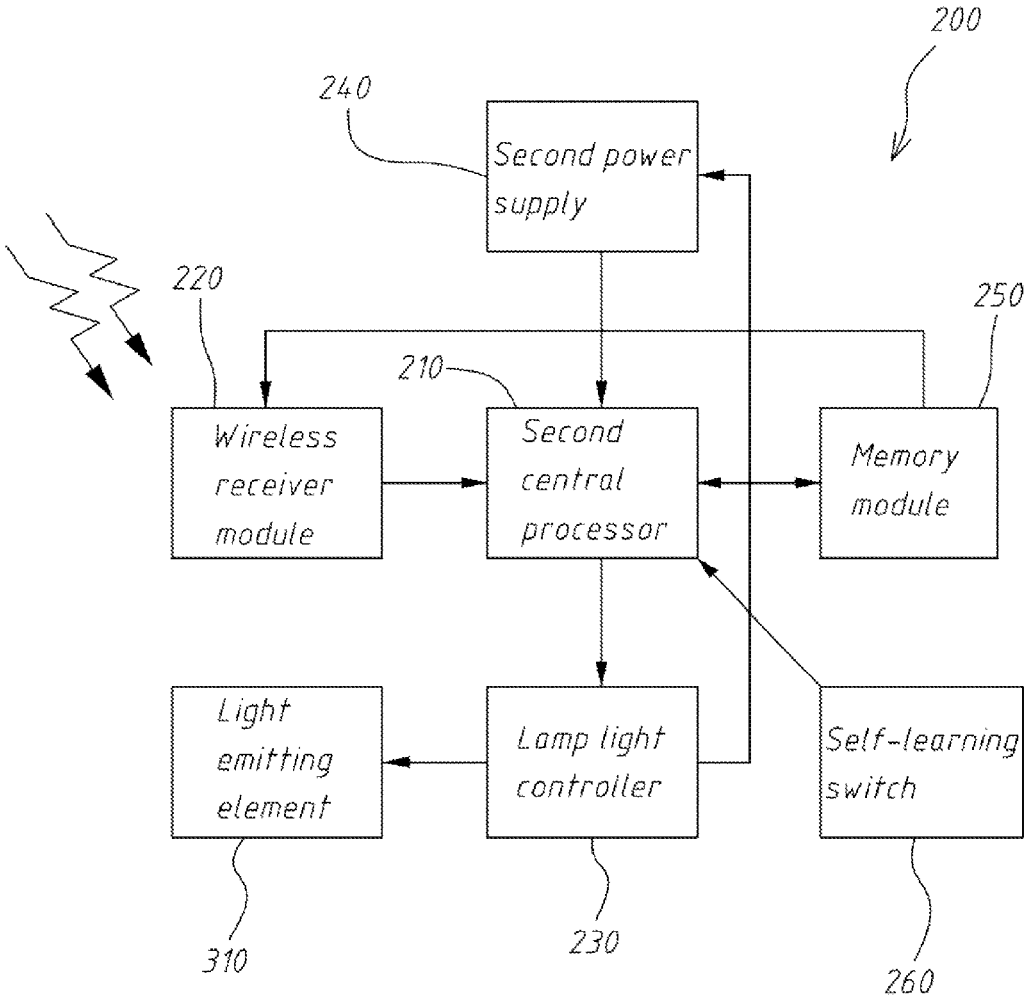
FIG. 3 is a configuration block diagram of a wireless receiver unit provided on a lamp to coordinately work with the lamp brightness remote controlling device of FIG. 1.

Please refer to FIG. 3 along with FIGS. 1 and 2. The lamp 300 includes at least one light emitting element 310, such as a cold cathode tube. The wireless receiver unit 200 provided on the lamp 300 includes a second central processor 210, a wireless receiver module 220, a lamp light controller 230, a second power supply 240, a memory module 250, and a self-learning switch 260. The wireless receiver module 220, the lamp light controller 230, the memory module 250 and the self-learning switch 260 are electrically connected to the second central processor 210. The second power supply 240 can be, for example, a commercial power source and is electrically connected to the second central processor 210, the wireless receiver module 220, the lamp light controller 230, and the memory module 250 for supplying power needed by these components to operate. It is noted the lamp light controller 230 is electrically connected in parallel to the light emitting element 310 of the lamp 300.

The wireless receiver module 220 receives the comparison signal transmitted from the wireless transmitter module 140 and sends the received comparison signal to the second central processor 210 for processing. After processing, the second central processor 210 outputs a control signal to the lamp light controller 230 for controlling the luminance of the light emitting element 310 and accordingly regulating the brightness of the lamp 300.

The memory module 250 stores the user-set data, and the self-learning switch 260 can trigger perfect coordination and match between the lamp brightness remote control device 100 and the wireless receiver unit 200.

The lamp brightness remote controlling device 100 according to the present invention is characterized by that the ambient brightness detector 120 detects the ambient brightness for comparing with the user-set brightness level and that a comparison signal is transmitted to the wireless receiver unit 200 on the lamp 300, so that the lamp light controller 230 automatically regulates the brightness of the lamp 300. When a difference between the detected ambient brightness and the user-set brightness level is relatively small, the lamp light controller 230 automatically regulates the lamp 300 to emit lower luminance; and when the difference between the detected ambient brightness and the user-set brightness level is relatively large, the lamp light controller 230 automatically regulates the lamp 300 to emit higher luminance. Therefore, the luminance of the lamp 300 can be controlled in response to the ambient brightness in the working environment to always keep the working environment at a preset level of brightness without the need of manually operating a remote controller to regulate the luminance of the lamp from time to time. Thus, the lamp brightness remote controlling device of the present invention is very convenient for use and has good applicability.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A lamp brightness remote controlling device for regulating a brightness level of a lamp correspondingly provided with a wireless receiver unit, comprising:

a first central processor;

an ambient brightness detector being electrically connected to the first central processor;

a setting key being electrically connected to the first central processor;

a wireless transmitter module being electrically connected to the first central processor; and a first power supply being electrically connected to the first central processor, the ambient brightness detector, and the wireless transmitter module; and the first central processor comparing a user-set brightness level set by a user via the setting key with an ambient brightness detected by the ambient brightness detector, computing, and then outputting a comparison signal to the wireless transmitter module for transmitting to the wireless receiver unit on the lamp, so that a luminance of the lamp is regulated according to the comparison signal to meet the user-set brightness level, wherein the wireless receiver unit on the lamp includes:

a second central processor;

a wireless receiver module being electrically connected to the second central processor;

a lamp light controller being electrically connect to the second central processor and a light emitting element of the lamp; and a second power supply being electrically connected to the second central processor, the wireless receiber module, and the lamp light controller.

2. The lamp brightness remote controlling device as claimed in claim 1, further comprising a time electrically connected to the first central processor.

3. The lamp brightness remote controlling device as claimed in claim 2, further comprising a display module electrically connected to the first central processor.

4. The lamp brightness remote controlling device as claimed in claim 3, further comprising a backlight module electrically connected to the first central processor.

5. The lamp brightness remote controlling device as claimed in claim 4, further comprising an auto/manual module electrically connected to the first central processor.

6. The lamp brightness remote controlling device as claimed in claim 5, wherein the wireless receiver unit further includes a memory module electrically connected to the second central processor and the second power supply.

7. The lamp brightness remote controlling device as claimed in claim 6, wherein the wireless receiver unit further includes a self-learning switch electrically connected to the second central processor.

* * * * *